US008387981B2

(12) United States Patent
Caron

(10) Patent No.: US 8,387,981 B2
(45) Date of Patent: Mar. 5, 2013

(54) BILLIARD BALL MIXING DEVICE AND WAGERING GAME

(76) Inventor: Erich Caron, Las Vegas, NV (US)

( * ) Notice: Subject to any disclaimer, the term of this patent is extended or adjusted under 35 U.S.C. 154(b) by 234 days.

(21) Appl. No.: 12/942,793

(22) Filed: Nov. 9, 2010

(65) Prior Publication Data

US 2012/0112409 A1 May 10, 2012

(51) Int. Cl.
*A63F 3/00* (2006.01)
*A63F 7/04* (2006.01)

(52) U.S. Cl. ..... 273/144 A; 273/144 R

(58) Field of Classification Search ..... 273/144 R, 273/144 A, 144 B
See application file for complete search history.

(56) References Cited

U.S. PATENT DOCUMENTS 2,003,979 A * 6/1935 Skoric ..... 273/144 A
4,364,567 A * 12/1982 Gootl ..... 273/237
D335,515 S 5/1993 Caron
D364,428 S 11/1995 Caron

OTHER PUBLICATIONS

Russian Roulette, 2008, 2 pages, unknown author.

* cited by examiner

*Primary Examiner* — Benjamin Layno
(74) *Attorney, Agent, or Firm* — Weide & Miller, Ltd.

(57) ABSTRACT

A billiard ball mixing device and wagering game provide an entertaining and enticing wagering game that utilizes billiard balls during play. The wagering game may utilize billiard balls to determine winning and losing outcomes. The mixing device may accept the billiard balls via an access point and have one or more stationary or movable agitators to mix the billiard balls, placing the balls into a random order. In one or more embodiments, the billiard balls may be removed from the mixing device preserving the random order. In this manner, winning and losing outcomes may be determined based on the randomized billiard balls.

19 Claims, 9 Drawing Sheets

FIG. 4

| | | |
|---|---|---|
| Perfect | 1/1 2/2 3/3 4/4 5/5 6/6 | 600 to 1 |
| Perfect Reverse | 6/1 5/2 4/3 3/4 2/5 1/6 | 600 to 1 |
| Zero | 3/1 4/2 1/3 6/4 2/5 5/6 | 3 to 2 |
| One | 5/1 2/2 4/3 1/4 6/5 3/6 | 3 to 2 |
| Any Two | 1/1 4/2 3/3 6/4 4/5 5/6 | 4 to 1 |
| Any Three | 1/1 2/2 3/3 5/4 6/5 4/6 | 15 to 1 |
| Any Four | 2/1 1/2 3/3 4/4 5/5 6/6 | 40 to 1 |
| Two or Three | 5/1 1/2 3/3 4/4 6/5 2/6 or 4/1 2/2 3/3 1/4 5/5 6/6 | 3 to 1 |
| Any 3,4,or Perfect | 1/1 3/2 6/3 4/4 5/5 2/6 or 1/1 2/2 5/3 4/4 3/5 6/6 or 1/1 2/2 3/3 4/4 5/5 6/6 | 10 to 1 |
| At Least One | 3/1 5/2 1/3 2/4 4/5 6/6 | 1 to 2 |

BILLIARD BALL MIXING DEVICE AND WAGERING GAME

BACKGROUND OF THE INVENTION

1. Field of the Invention

The invention relates to table wagering games, and particularly to a billiard ball wagering game comprising a mixing device and rules of play therefor.

2. Related Art

Traditional table games, such as craps and roulette, are often relatively complex and thus dissuade some players from participating. In these games players must be able to quickly determine winning and losing outcomes, and adjust their betting strategy accordingly. However, this is made difficult due to the various bets, playing pieces, and movements thereof during a game.

Other traditional games, such as keno and bingo, have reduced complexity to an extent that only limited excitement may be provided by the game. This is supported by the fact that keno is often played as a side attraction in cafes and eateries. Rarely is keno the focus of a player's attention for instance, and bingo may be played with electronic devices that mark player cards automatically. As such traditional games with reduced complexity also dissuade players from participating. In addition, keno and similar games provide little visual stimulation and thus do not entice players to place wagers or otherwise participate.

From the discussion that follows, it will become apparent that the present invention addresses the deficiencies associated with the prior art while providing numerous additional advantages and benefits not contemplated or possible with prior art constructions.

SUMMARY OF THE INVENTION

A billiard ball mixing device and wagering game is disclosed herein. The game may utilize the billiard balls to determine winning and losing outcomes. In this manner, the wagering game takes advantage of various characteristics of billiard balls. For example, the unique color and livery of billiard balls, their ability to roll, and their weight add to the attractiveness of the wagering game and provide a unique experience to players playing the wagering game.

Various wagering games are disclosed herein. In one embodiment for example, a wagering game may comprise a table layout comprising one or more to betting areas, and a mixing device configured to accept a plurality balls and to randomize the plurality of balls by moving the plurality of balls into a random order. The betting areas may be configured to accept at least one wager from one or more players.

Each of the plurality of balls may comprise at least one unique indicia. The plurality of balls may be billiard balls and the unique indicia of the billiard balls may be a number and a color on the billiard balls. The mixing device may comprise an enclosed mixing chamber configured to accept the balls, and at least one agitator configured to move the plurality of balls into the random order.

A display area in which the plurality of balls may be presented to the players in the random order may be included as well. The display area may have a plurality of locations arranged along a path, with each of the plurality of locations configured to accept one of the plurality of balls. The plurality of locations may each have a unique color.

A paytable comprising one or more winning outcomes with each of the winning outcomes identifying at least a number of the plurality of balls that must be in a particular location of the display area may also be provided. The winning outcomes comprise a first winning outcome requiring one of the plurality of balls to be in a particular location, and a second winning outcome requiring at least two of the plurality of balls to be in at least two particular locations. Alternatively or in addition, the winning outcomes comprise a winning outcome requiring each of the plurality of balls to be in a particular location.

Various mixing devices are also disclosed herein. In one embodiment, a billiard ball mixing device for a wagering game may comprise a mixing chamber configured to accept a plurality of billiard balls, one or more access points configured to allow the plurality of billiard balls to pass into and out of the mixing chamber, and at least one moving agitator within the mixing chamber.

The mixing chamber may comprise a bottom and one or more walls, the bottom configured to support the plurality of billiard balls during mixing. The bottom may be sloped towards one of the access points, towards one of the moving agitators, and/or to alter the direction in which the plurality of billiard balls roll within the mixing chamber. The bottom may be substantially planar. The moving agitator may be configured to roll one or more of the plurality of billiard balls in one or more directions on the bottom of the mixing chamber.

The moving agitator may move in a rotary fashion. A drive mechanism may be coupled to the moving agitator, with at least a portion of the drive mechanism extending out of the mixing chamber. A handle may be coupled to the moving agitator. The handle may be mounted outside the mixing chamber and configured to turn the moving agitator. At least one stationary agitator may be within the mixing chamber and attached to an interior portion of the mixing chamber such as the wall(s), bottom, and/or top of the mixing device.

Various methods involving wagering games and mixing devices are disclosed herein as well. In one embodiment. a method for presenting a wagering game with billiard balls comprises accepting at least one wager from a player, placing a plurality of billiard balls into a mixing chamber, rolling the plurality of billiard balls within the mixing chamber to cause the plurality of billiard balls to have a random order, and presenting the plurality of billiard balls in the random order to one or more players. The plurality of billiard balls may be presented by placing the plurality of billiard balls on a gaming table surface in the random order.

The position of the plurality of billiard balls within the random order to may be evaluated determine a winning outcome. The player may be paid a payout for correctly predicting the position of the plurality of billiard balls within the random order. It is noted that the mixing chamber may be provided and positioned at a gaming table.

Rolling the plurality of billiard balls may occur in various ways. For example, rolling the billiard balls may consists of rolling the plurality of billiard balls on a bottom of the mixing chamber. Alternatively or in addition, rolling the plurality of billiard balls may comprise rotating an agitator within the mixing chamber to roll the plurality of billiard balls.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 4 illustrates an exemplary paytable for a billiard ball wagering game.

DETAILED DESCRIPTION OF THE PREFERRED EMBODIMENTS

Figure 1A:
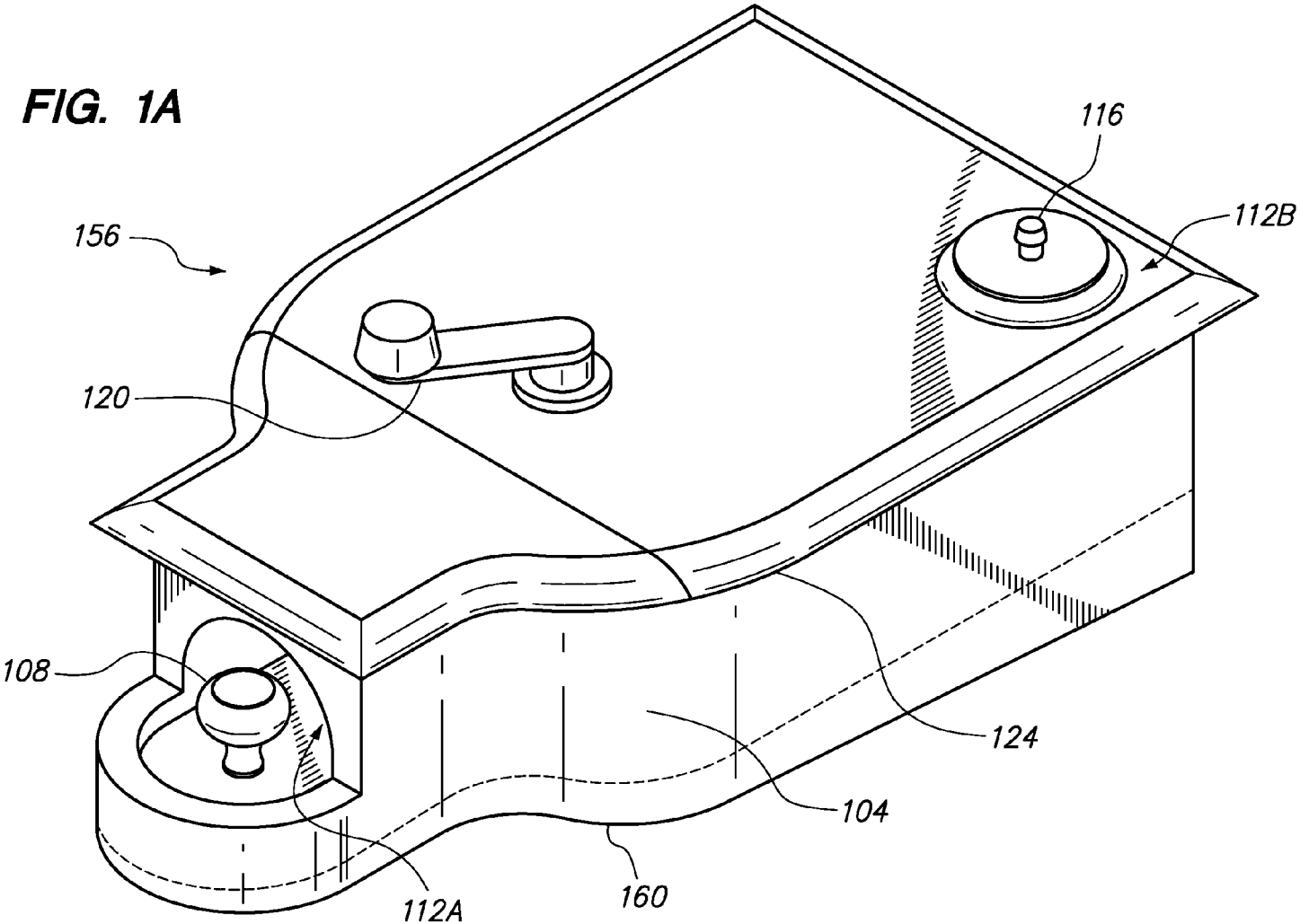
FIG. 1A is a top perspective view of an exemplary mixing device.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The mixing device and wagering game herein combine to provide an engaging and entertaining game that overcomes drawbacks in the prior art. In one or more embodiments, the mixing device and wagering game utilize a combination of color, motion, and wagering rules that together provide an engagement and entertainment that players desire. In fact, it is contemplated that players may be enticed to play the wagering game after seeing it and the mixing device in operation.

The wagering game takes advantage of the shape and decorative features of billiard balls. For instance, the spherical shape of the billiard balls allow them to be randomly mixed and used during the wagering game. In addition, as will be described further below, the color and other indicia on the billiard balls allow individual balls to be easily identified during play of the wagering game. For instance, in some embodiments, player may identify a winning or losing outcome based on the color of the billiard balls. Unlike traditional (non-card based) table games, such as roulette or craps, winning and losing outcomes are easily identified and as such a player may more easily formulate a betting strategy.

Various mixing devices are disclosed herein for use with the game. In general, a mixing device accepts one or more billiard balls and randomizes them. This results in a random sequence of billiard balls that may be used to determine one or more outcomes for the wagering game.

Since billiard balls have a weight, size, and shape designed for the entirely distinct game of billiards, the mixing device includes elements that aid in randomizing the billiard balls. Typically, billiard balls are valued for their ability to roll or move in a straight predictable path after being struck by another ball or by a player (in the case of the cue ball). In traditional use, billiard balls are not randomized or mixed. In fact, many games of billiards require billiard balls to be "hit" in a particular order.

The mixing device will now be described with regard to FIGS. 1A-1D. As can be seen, the mixing device 156 may comprise a mixing chamber 104 where the mixing of billiard balls 152 may take place. As can be seen in FIG. 1D, the mixing chamber 104 may be an enclosing structure in one or more embodiments, the accept the billiard balls 152 and to contain the billiard balls as they are mixed.

In one or more embodiments, the mixing chamber 104 may comprise one or more walls to keep the billiard balls 152 in the mixing chamber. The mixing chamber 104 may also comprise a top 124 and a bottom 160. It is contemplated that the top 124, bottom 160, or both may be removable, such as to repair, maintain, or upgrade the mixing device 156 or components thereof. If removable, the top 124, bottom 160, or both may be secured by one or more locks or other locking mechanisms to prevent tampering when the mixing device 156 is in use. It is contemplated that various components of the mixing device 156 may be built to one or more standards and/or labeled to help ensure their authenticity. In this manner, players, gaming establishments, and authorities may be assured that the mixing device 156 is randomizing the billiard balls 152 properly.

The bottom 160 or portions thereof may be sloped, angled, or curved such as to cause the billiard balls 152 to move one or more particular directions by the force of gravity. This may be used to aid in randomizing the billiard balls 152, as will be described further below. To illustrate, it can be seen in FIG. 1B that the bottom 160 may be sloped towards a side or other portion of the mixing device 156. Though shown with a single slope, it is noted that the bottom 160 may have one or more slopes, ridges, valleys, channels, protrusions, indentations, and other features that cause the billiard balls 152 to roll a particular way or in a particular direction within the mixing device 156.

In one or more embodiments, the mixing device 156 may have one or more access points 112 configured to allow billiard balls 152 to be added to or removed from the mixing device. For example, a first access point 112A and a second access point 112B are shown in the exemplary embodiment of FIGS. 1A-1B. The first access point 112A may be used to remove billiard balls 152 from the mixing device 156, while the second access point 112B may be used to insert billiard balls. Alternatively, the second access point 112A may be used to remove billiard balls 152, while the first access point 112A may be used to insert billiard balls. It is contemplated that only a single access point may be provided in some embodiments, and that the single access point may be used to both insert and remove billiard balls 152. For instance, billiard balls 152 may be inserted and removed from the first opening 112A in some embodiments, negating the need for a second opening 112B (or vice versa).

The access points 112 may be covered or otherwise blocked to retain the billiard balls 152 in the mixing chamber 104. In addition, the access points 112 may be blocked to prevent the mixing or randomization process from being seen and/or tampered with. For instance, each access point 112 may have a blocking device or other removable obstruction that prevents access to the mixing chamber 104 and/or prevents billiard balls 152 from escaping (or being removed from) the mixing chamber.

A blocking device may have various configurations. For instance, in one embodiment, the blocking device may be a plug or bung which blocks an access point 112. In another embodiment, the blocking device may be a hinged structure, such as a flap or cover, which pivots relative to a wall, top, bottom, or other portion of the mixing chamber. The blocking device may be a sliding cover or flap which may slide at an access point 112 to block or unblock the access point. The blocking device need not cover the entire opening formed by an access point 112. For example, the blocking device may be one or more elongated members or other structures which span across the opening of an access point. Once inserted, a blocking device may be held in place in one or more embodiments. For example, a blocking device may be held in place by friction, gravity, one or more fasteners (e.g., magnets, clips, clamps, screws, pins, hook and loop fasteners, zippers, buttons, etc. . . . ), or other structures (e.g., threaded or other mating/locking structures).

Figure 1B:
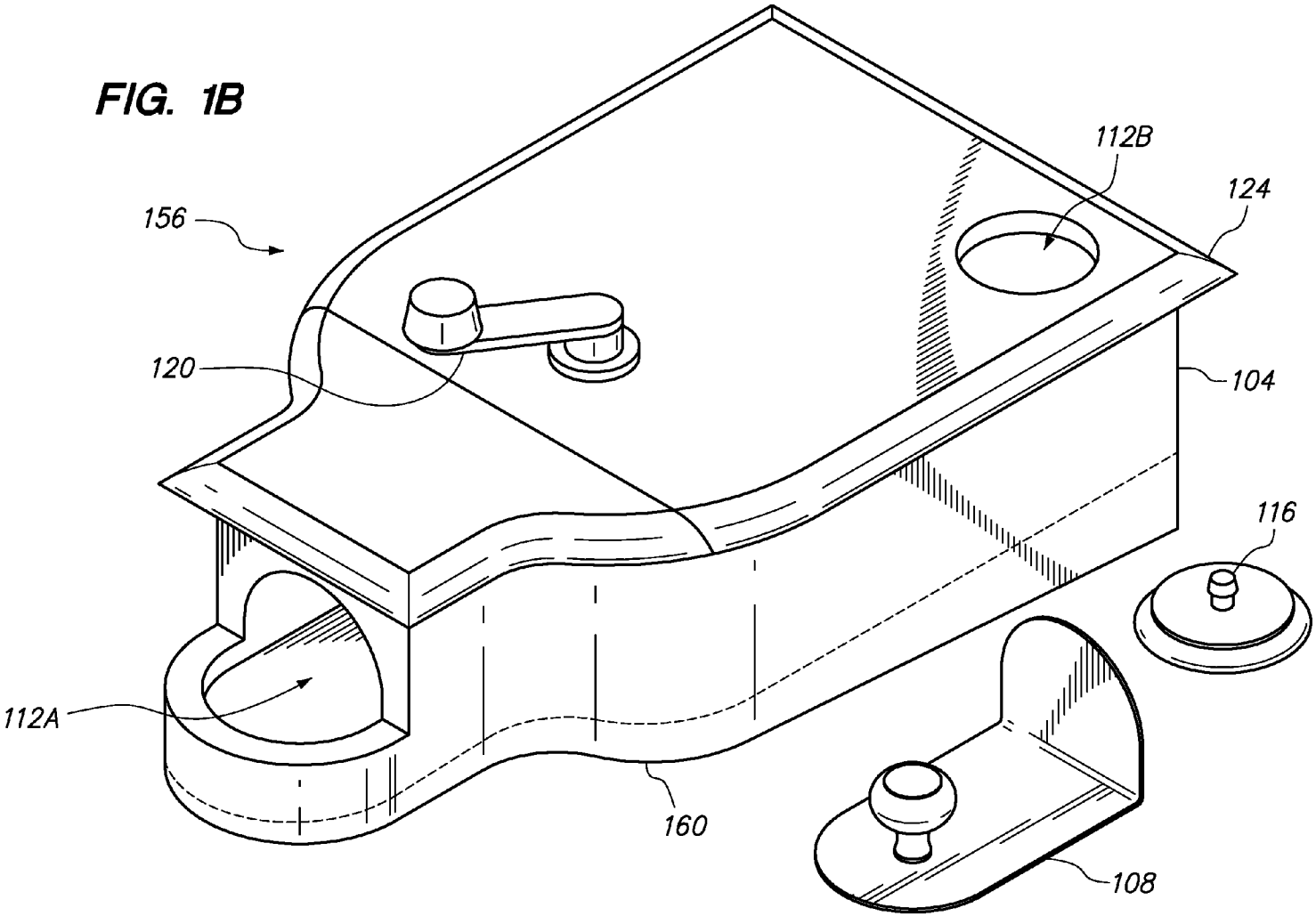
FIG. 1B is a top perspective view of an exemplary mixing device.

In the exemplary embodiment of FIG. 1A, the first access point 112A has blocking device comprising a stopper 108 that prevents billiard balls 152 from coming out of the mixing chamber 104 while the stopper is in place. The second access point 112B has a blocking device comprising a removable cover 116 or top that prevents access to the mixing chamber 104 while in place. As can be seen in FIG. 1B, these blocking devices (e.g., cover 116 and stopper 108) may be removed to allow access to the mixing chamber 104, such as to add or remove billiard balls 152. In the embodiment shown, the stopper 108 may block the first access point 112A while billiard balls 152 are inserted at the second access point 112B. The second access to point 112B may then optionally be blocked or closed by its cover 116 prior to randomizing the billiard balls 152.

It is contemplated that a blocking device may be configured to work in concert with the mixing chamber 104 to randomize the billiard balls 152. For example, the blocking device may have a shape or size which maintains or alters the motion of the billiard balls 152 as they are being mixed or randomized. To illustrate, the stopper 108 has an elongated shape and a planar surface (adjacent its "L" shaped bend) which faces the mixing chamber 104 when the stopper is inserted. This allows the stopper 108 may be flush (or substantially flush) with a wall of the mixing chamber when the stopper is in place. In this manner, the billiard balls 152 may move in a continuous fashion along the walls of the mixing chamber 104 when being mixed.

The stopper 108 (or other blocking device) may be configured to have a variety of shapes and various effects on the mixing of the billiard balls 152. For example, rather than forming a portion of the mixing chamber's wall, the stopper 108 may protrude a distance into the mixing chamber, or may be inset at the wall of the mixing chamber. In this manner, the stopper 108 may assist in randomizing the billiard balls 152 by physically contacting and altering their movement within the mixing chamber.

It is contemplated that the stopper 108 may be shaped to aid in mixing the billiard balls 152. For example, a portion of the stopper 108 that protrudes into the mixing chamber may have a triangular, curved, rectangular, or other shape that aids in randomizing the billiard balls 152. In addition or alternatively, the stopper 108 may have a curved, angled, or other surface to aid in randomization. The stopper 108, or various portions thereof may also be textured to provide varying amounts of friction or resistance as the billiard balls 152 come into contact with the stopper.

As illustrated, the cover 116 may be used to block the second access point 112B. It is noted that, as described above with regard to the stopper 108, the cover 116 (or another blocking device) may also aid in mixing or randomizing the billiard balls 152. For instance, the cover 116 may protrude into the mixing chamber or be inset therefrom to change the motion of the billiard balls 152 within the mixing chamber. The cover 116 could alternatively be flush with and/or form a portion of the walls, top, or bottom of the mixing chamber.

Figure 1C:
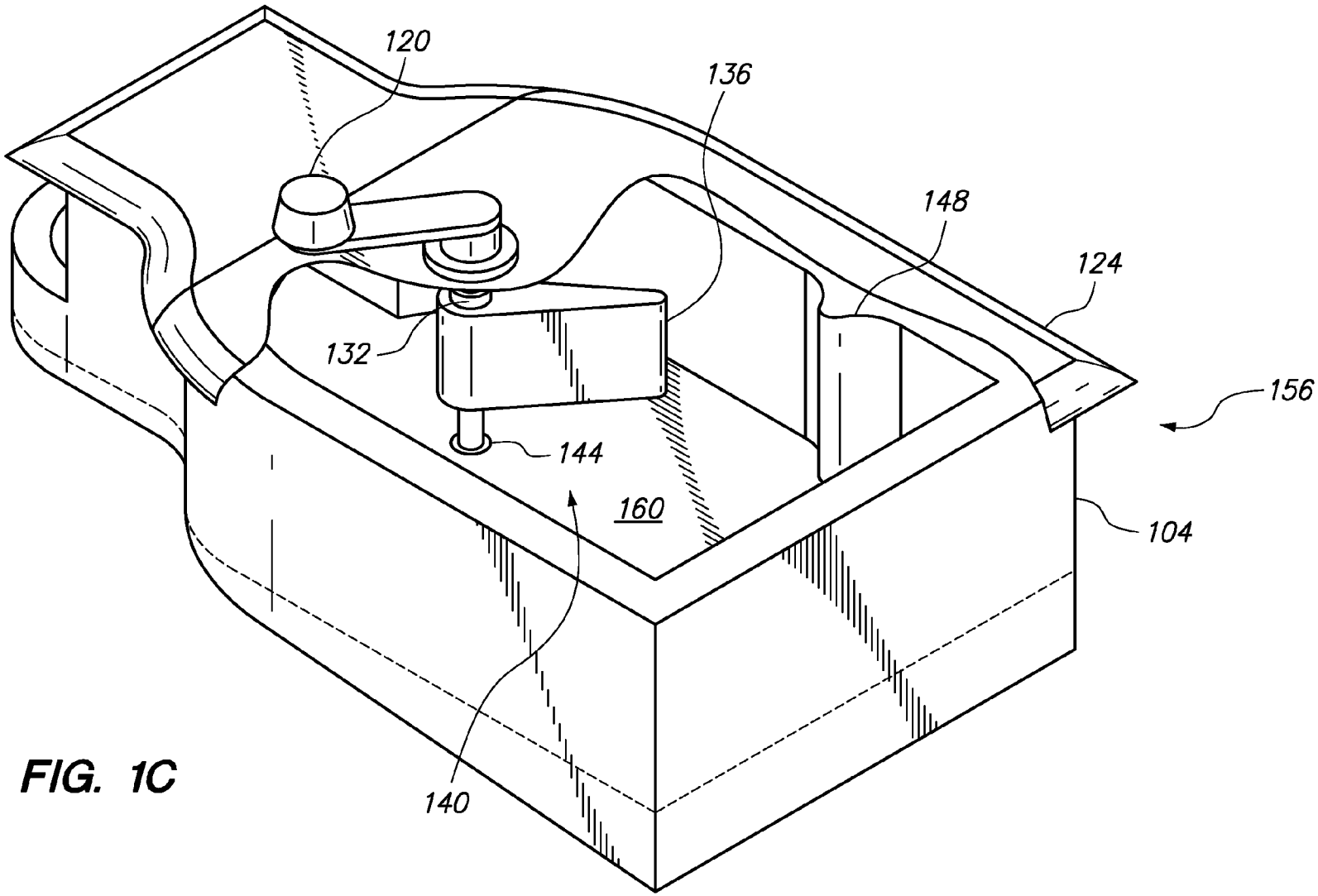
FIG. 1C is a top perspective view of the interior of an exemplary mixing device.
Figure 1D:
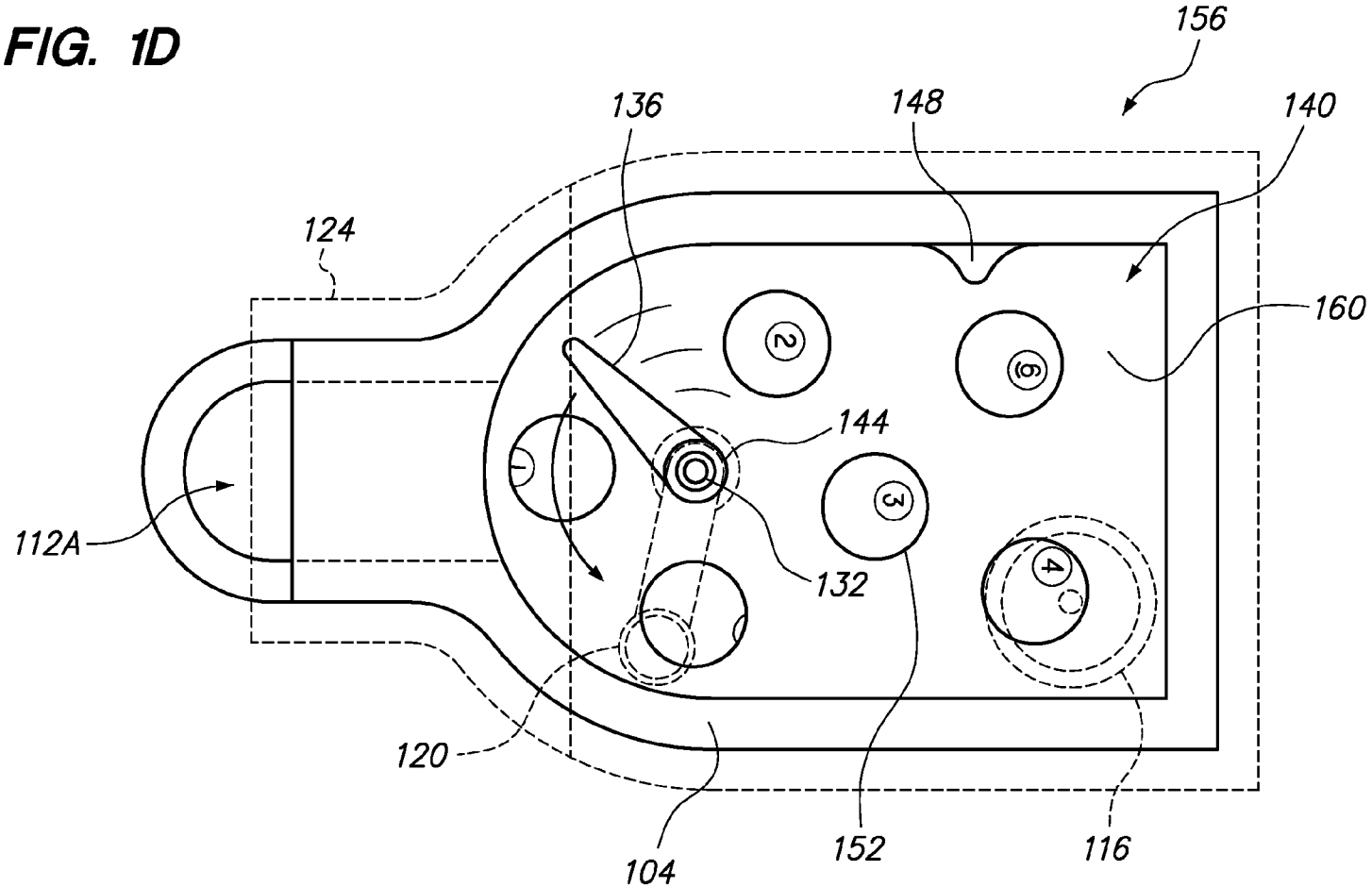
FIG. 1D is a top view of an exemplary mixing device in operation.

FIGS. 1C-1D provide a view of the inner workings of an exemplary mixing device 156. As can be seen, the mixing device 156 may include one or more internal components used to properly randomize billiard balls 152. In one or more embodiments, an agitator assembly may be provided to randomize the billiard balls 152. In general, the agitator assembly is configured to move the billiard balls 152 within the mixing chamber 104 such that the sequence of order of the billiard balls becomes random as the billiard balls are removed from the mixing chamber.

The agitator assembly may comprise one or more moving agitators that strike, push, pull, or otherwise move the billiard balls 152 within the mixing chamber 104. In addition or alternatively, the agitator assembly may also include one or more stationary agitators which alter the movement of the billiard balls 152 within the mixing chamber so as randomize the billiard balls. An agitator may be rigid or flexible structure configured to produce or change the motion of at least one billiard ball 152 through physical contact with the ball. The surface or other section of an agitator may be hard or may be soft or resilient. In one or more embodiments, the agitator or one or more portions thereof may be rubber or a similar material such as to cause billiard balls 152 to bounce off the agitator.

An agitator may have various shapes and sizes as well. For example, in FIG. 1C, two exemplary agitators are shown. As shown, the first agitator is configured as a paddle 136, while the second agitator is configured as a bumper 148. The paddle 136 comprises an extended tapered rectangular shape, while the bumper 148 has a triangular shape (when viewed from the top). Various other shapes are contemplated. For example, (also when viewed from the top) an agitator may be a curved or crescent shape, rectangular, square, various triangles, polygonal, or various other shapes including curves, angles, straight sections, or a combination thereof.

Proper randomization of the billiard balls 152 is critical to providing outcomes for the wagering game herein. If the billiard balls 152 were not truly randomized, players may notice and cease playing the game. In addition, a gaming establishment may not wish to provide the wagering game. Moreover, a gaming regulator or other authority may not permit the wagering game to be played without proper randomization of the billiard balls.

Though it is contemplated that the billiard balls 152 may be mixed in a rotating drum (similar to that of a cement mixer), this may not be desirable due to the noise involved. In addition, the tumbling of the heavy billiard balls 152 within the drum would quickly wear down and damage the billiard balls, especially their decorative coatings. Other methods of mixing involving dropping or tumbling the billiard balls 152 would also have similar drawbacks.

As such, the agitator assembly may be configured to randomize the billiard balls 152 without damaging them or reducing their life. Accordingly, in one or more embodiments, the billiard balls 152 may be supported during the randomization process so as to prevent them from falling or dropping. This greatly reduces, if not eliminates, damage that may be caused during randomization.

To illustrate, as can be seen in FIG. 1D, the bottom 160 of the mixing chamber 104 may support the billiard balls 152 so that they may roll on the bottom of the mixing chamber while they are randomized. Though this reduces or eliminates damage to the billiard balls 152, it also makes the balls more difficult to randomize properly. For example, when rolled, billiard balls 152 tend to cluster together within the mixing chamber when one or more of them are pushed or pulled. Though the outside balls 152 of a cluster may change positions, the inside balls may remain largely unmixed. Striking one or more of the billiard balls 152 against the other billiard balls typically only increases the distance between the balls (such as when a cue ball hits a rack of billiard balls), without mixing or randomizing the location of the balls.

Therefore, to achieve proper randomization while supporting the billiard balls 152, agitator(s) of the agitator assembly may have particular positions and configurations (e.g. constituent materials, shapes, and sizes). In addition, in one or more embodiments, the agitators may be positioned and configured to achieve proper randomization quickly. This is highly advantageous in that it permits more games to be played leading to potentially greater profits for a gaming establishment.

As will now be described, a careful balance between the number, shape, and size of a mixing chamber's agitators, and the shape and size of the mixing chamber 104 itself is used to properly randomize the billiard balls 152. For example, as shown in FIGS. 1C-1D, the paddle 136 (or other agitator) may have a length such that there is a space between the distal end of the paddle and one or more walls of the mixing chamber 104. Since the space between the distal end of the paddle 136 and the one or more walls may change as the paddle moves within the mixing chamber 104, in some embodiments, it is contemplated that the length of the paddle may be such that there is a space of at least the width of one billiard ball 152 between the distal end of the paddle and the wall regardless of the paddle's orientation or position. Also as shown in FIGS. 1C-1D, the bumper 148 (or other agitator) may extend a particular distance from a wall of the mixing chamber. For example, the bumper 148 may extend 1 in to 6 in from the wall in one or more embodiments.

In one embodiment, the mixing chamber may be 9 in wide by 1 in long (inside measurements) and be used with a 3¼ in paddle 136 and a ¾ in bumper 148 to randomize the billiard balls 152 well.

As stated, the agitator assembly may move billiard balls 152 within the mixing chamber to randomize the billiard balls. In one or more embodiments, the billiard balls 152 may be randomly mixed in a rotary fashion. For example, a paddle 136 or other agitator may be rotated to agitate the billiard balls 152. Contact between the paddle 136 and a billiard ball 152 may cause the ball to move within the mixing chamber. The billiard ball 152 may also come into contact and move other billiard balls within the mixing chamber.

As shown in FIG. 1C for example, a paddle 136 may be mounted to a rotating assembly that powers the movement of the paddle. For example, as shown by FIGS. 1C-1D, the paddle 13 may be mounted to an axle 132. The axle 132 may be supported by a bushing, bearing, or other rotatable mount. In some embodiments, the mixing chamber 104 may include one or more structures to rotatably hold the axle 132. For example, the mixing chamber 104 may comprise one or more indentations, protrusions, threaded portions, detents, or other structures which rotatably hold the axle. As illustrated, the mixing chamber 104 comprises a circular opening 144 in its bottom 160 which accepts an end of the axle 132. The other end of the axle 132 may be rotatably held by the top 124 in one or more embodiments.

It is contemplated that only one end of an axle 132 need be supported in some embodiments. For example, a rotatable mounting at the top 124 may support the axle 132 alone. In addition, it is contemplated that one or more other portions (such as the walls) of a mixing chamber 104 may support the axle 132 in some embodiments. In this manner, the axle 132 may extend within the mixing chamber 104 at various positions and angles. Accordingly, the paddle 136 or other agitator may also be rotated at various positions and angles within the mixing chamber 104.

The rotating assembly may include a drive mechanism in one or more embodiments. In general, the drive mechanism provides the motion required to move one or more agitators. The drive mechanism may be mechanically powered or manually powered in its various embodiments. For example, the drive mechanism may be an electrical, gas, or other motor. It is contemplated that the drive mechanism may be mechanically powered by various attention-getting contraptions. For example, the drive mechanism may be powered by falling water, like a paddlewheel. This may entice players to play and add entertainment value to the mixing device 156 and associated wagering game.

Manually powered drive mechanisms may have a variety of configurations as well. For example, one or more pedals, levers, actuators, plungers, or the like may be manually rotated or moved to move one or more agitators. As another example, referring to FIGS. 1A-1C, it can be seen that the drive mechanism may comprise a handle 120 or hand crank that may be manually rotated to move one or more agitators.

The drive mechanism may be directly connected to an agitator directly or indirectly. For example, a rotating drive shaft (or the like) of a drive mechanism may be directly attached to an agitator. Alternatively or in addition, the drive shaft may be connected to one or more other structures which transfer the power from the drive shaft to one or more agitators. For example, as shown in FIGS. 1C-1D, a drive shaft of the handle 120 may connect to an axle 132 which transfers rotational movement from the handle to the paddle 132. Though shown configured to rotated about a central axis, it is noted that the paddle 132 or other agitator may be mounted off-center such as to give the paddle an oblong or oval pattern of movement.

It is noted that a manually powered drive mechanism, such as a handle 120 or hand crank, may be advantageous in randomizing the billiard balls 152 in some embodiments. This is because it is naturally difficult for a user to move an agitator with absolute consistency. The randomness of the user's movement may aid in randomizing the billiard balls 152. It is contemplated, that a user may purposely move an agitator in an inconsistent or erratic fashion when randomizing the billiard balls 152. In mechanically powered embodiments, it is contemplated that one or more controls may be used to allow a user to control the drive mechanism in this manner. Alternatively, an electronic or mechanical controller or other control device may operate the mechanical drive mechanism in a random fashion, such as by randomly altering the speed of the drive mechanism.

In operation, one or more agitators may rotate, pulsate, actuate, or otherwise move. This causes the billiard balls 152 to move within the mixing chamber 104. In addition, one or more other agitators may be stationary and may serve to alter the movement of the billiard balls 152. The bottom 160 of the mixing chamber 104 may be sloped or have various surfaces to also affect the movement of the billiard balls 152 as well, such as described above. Various combinations of moving agitators, stationary agitators, and bottoms of the mixing chamber 104 may be used to randomize the billiard balls 152.

As can be seen from the exemplary embodiment FIGS. 1C-1D, the paddle 136 may be rotated to move the billiard balls 152 within the mixing chamber 104. Such rotation may cause some or all the billiard balls 152 to move. The billiard balls 152 may also collide with one another causing additional motion. Since the paddle 136 may be rotated at varying speeds, the movement of billiard balls 152 within the mixing chamber 104 becomes random.

In one or more embodiments, the paddle 136 may be rotated a number of times, stopped, and then rotated another number of times to randomize the billiard balls 152. For example, during testing it has been shown that rotating the paddle 136 to five times, with a pause to let the billiard balls 152 settle, followed by another five rotations randomizes the billiard balls.

As can be seen from the exemplary embodiment of FIG. 1B, the paddle 136 may be at one side of the mixing chamber 104. This enlarges the area in which the billiard balls 152 may mix. In other words, positioning the paddle 136 at one side of the mixing chamber 104 increases the space on another side of the mixing chamber within which the billiard balls 152 may move and mix. As can be seen from FIG. 1D, this "mixing" area may have one or more other agitators, such as the bumper 148 illustrated in FIG. 1D. As the billiard balls 152 move in the mixing area, they may contact one or more agitators, such as the bumper 148, which changes the direction/speed of their motion and thus helps ensure the balls are randomized.

The bottom 160 of the mixing chamber 104 may be configured to direct one or more billiard balls 152 to one or more agitators. As shown for example, the bottom 160 of the mixing chamber 104 shown in FIGS. 1A-1B directs billiard balls 152 toward the paddle 136 by sloping toward the paddle. As can be seen, the ability to direct the motion of the billiard balls 152 allows the paddle 136 or other agitator to be placed at various locations within the mixing chamber 104. As discussed above, the bottom 160 of the mixing chamber 104 may have various channels or other surface features which guide the billiard balls 152 to the paddle 136 (or other agitator) and/or an access point 112 of the mixing chamber. In addition or alternatively, the slope, channels, or surface features may guide billiard balls 152 to various other locations of the mixing chamber 104.

Mixing may occur for a predetermined period of time or for a randomly selected period of time. In some embodiments, there may be a minimum period of time for mixing to ensure that the billiard balls 152 are properly randomized. It is contemplated that, in some embodiments, moving one or more agitators at a higher rate of speed may reduce the amount of time that mixing occurs, while ensuring proper randomization. A timer may be provided to time the mixing process. A user may turn or otherwise operate an agitator according to the time provided by the timer. Alternatively a control system may be turned on and off by the timer to provide the desired period of mixing.

In some embodiments, access to the billiard balls 152 and/or mixing chamber 104 may be prevented until the balls have been mixed for the total predetermined time. For example, one or more access points 112 may be locked until mixing has occurred for a predetermined time. In some embodiments, the total mixing time may be determined by the time one or more agitators within the mixing chamber 104 have been moving. This helps ensure the billiard balls 152 are properly randomized. To illustrate, in a manually powered embodiment, if the users stops moving an agitator for a period of time, this period may not be counted towards the total mixing time.

Once mixing is complete, the billiard balls 152 may be removed form the mixing chamber 104. As discussed above, this may occur by removing the billiard balls 152 through or from an access point 112 of the mixing chamber. The billiard balls 152 will typically be removed one at a time from the mixing chamber 104. This preserves the random order which was generated by the mixing process. One or more stoppers 108, covers 116, or other blocking structures may be removed to allow the billiard balls 152 to be removed. In some embodiments, the blocking structure(s) may be motorized or automated such that they automatically open when mixing is complete. For example, the timer may trigger a motor, servo, catch, or the like to move a blocking structure which in turn allows the billiard balls 152 to be removed.

In one embodiment, the billiard balls 152 may be removed as they "emerge" from the mixing chamber 104. For example, in FIG. 1B, the bottom 160 of the mixing chamber 104 is configured (i.e., sloped) to direct the billiard balls 152 to an access point 112A (in addition to the paddle as discussed above). Accordingly, the billiard balls 152 roll to the access point 112A once the stopper 108 is removed. The access point 112A may be sized and/or shaped to allow billiard balls 152 to enter/exit the access point one at a time. As shown in FIG. 1B for example, the access point 112A forms a tunnel-like structure which allows individual billiard balls 152 to "emerge" from the mixing chamber 104 one at a time.

The access point 112A may comprise a holding area which holds a billiard ball 152 in position for removal, such as shown in FIG. 1B. Once removed, another billiard ball 152 may enter the holding area for subsequent removal. The holding area may hold a billiard ball 152 stationary and provide convenient access to the ball such that a user may easily remove the ball. In one or more embodiments, only a single billiard ball 152 may be in the holding area at one time. This helps ensure that the billiard balls 152 are removed from the mixing chamber in their randomized order, thus preserving the randomization generated by the mixing process.

The billiard balls may be placed into play once removed from the mixing device. In one or more embodiments, the wagering game may include one or more ball placement areas at which the billiard balls may be placed in the order they emerge from the mixing device. Stated another way, ball placement area(s) allow the billiard balls to be displayed to players in their randomized order (as created by the mixing process).

Figure 2A:
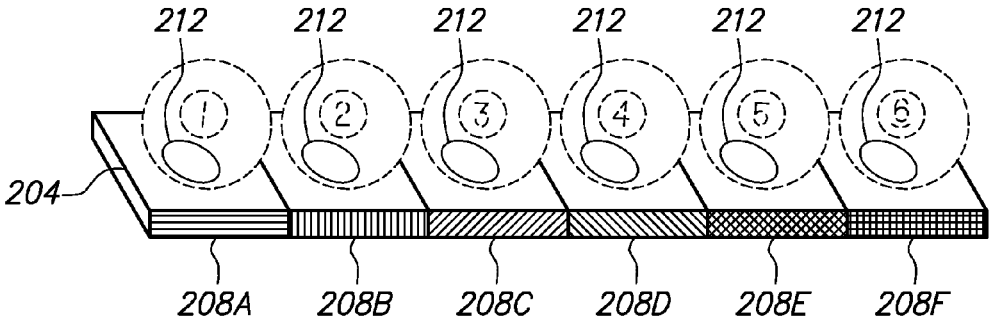
FIG. 2A is a front perspective view of an exemplary ledger.
Figure 2B:
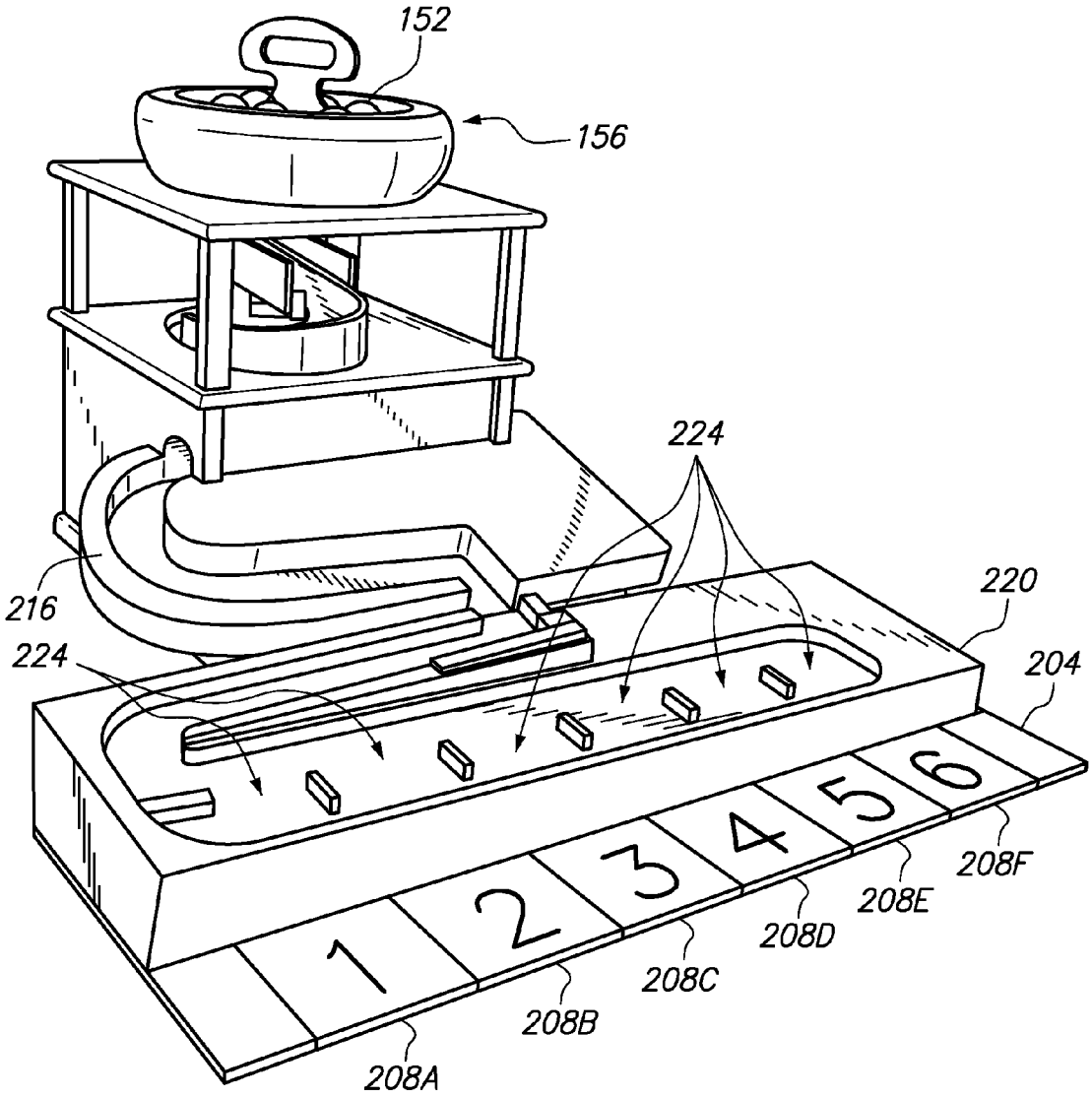
FIG. 2B is a front perspective view of an exemplary billiard ball transfer mechanism and ledger.

A ball placement area may include various structures and/or indicators. FIGS. 2A-2B illustrate exemplary ball placement areas. In the embodiment of FIG. 2A, the ball placement area comprises a ledger 204 having sections 208 to accept individual billiard balls 152. As shown, the sections 208 have been delineated by color (illustrated as shading). It is noted that the sections 208 may also be separated by other indicators, such as lines, labels, and the like. In the embodiment of FIG. 2A, it can be seen that the ledger 204 has six sections 208A-208F, each having its own color (shown by the shading patterns in FIG. 2A). It is noted that the ledger 204 may have more or fewer sections 208, such as to accept more or fewer billiard balls 152. In this way, a wagering game may be played with various numbers of billiard balls.

The color of each section 208 may match the color of a particular billiard ball 152 in one or more embodiments. This may represent a desirable combination of billiard balls 152, such as a winning combination. If the randomized order of the billiard balls 152 matches that of the sections 208, a winning or desirable outcome may be declared. In FIGS. 2A-2B, the colors/patterns of the ledger 204 have been arranged such that a matching set of billiard balls 152 would be in order from one to six. A player having made a wager on this outcome would thus be a winner in one or more embodiments.

Each section 208 may also or alternatively be labeled with text, graphics, characters, other symbols or various combinations thereof. FIG. 2B shows a ledger 204 having sections 208 that are both colored and numbered for example. It is noted that the symbols or colors may indicate more than one desirable outcome. For example, symbols of a first type or group may indicate a first desirable outcome while symbols of a second type or group may indicate a second desirable outcome. The color or symbols may be at various areas of a section 208. In some embodiments, the color may cover the entire section 208. It is contemplated that colors or symbols may be used individually or in combination on various ledgers 204 or other ball placement areas. It is contemplated that the sections 208 need not be associated with a color or symbol in some embodiments.

In one or more embodiments, a ball placement area may be configured to retain or hold one or more billiard balls 152 in position. This is advantageous because the spherical shape of the billiard balls 152 may make them difficult to keep in one place. To illustrate, FIG. 2A shows a ledger 204 having indentations or divots 212 configured to hold the billiard balls 152 in position. This secures the billiard balls 152 and allows them to be easily placed and held within a section 208 for display during play. Without such holding mechanism, the billiard balls 152 may roll about or may be difficult to properly place or display. For instance, without a holding mechanism, the billiard balls 152 may be difficult to place within a section such that their numbers are easily seen. The surface of the ball placement area or portion thereof (e.g., section 208 or divot 212) may be textured to "grip" a billiard ball 152 in one or more embodiments.

A holding mechanism need not be provided in all embodiments. For example, FIG. 2B illustrates a ledger 204 having sections 208A-208F that are planar in configuration. The sections 208 may be delineated with color, labels, or both such that a user may easily see each section as a separate area. The billiard balls 152 may be placed directly on the planar surface of these sections 208. As another example, a section of a gaming table surface may be used to form a ball placement area. To illustrate, the felt of the table may have one or more indicators and/or colors to indicate sections 208 in which billiard balls 152 may be placed. Alternatively, the felt may only indicate, such as with an outline and/or label, one or more ball placement areas on the table's surface.

In one or more embodiments, the placement area, such as a ledger 204, may be at various locations. In one embodiment, the ball placement area may be on the table surface of a gaming table. In another embodiment, the ball placement area may be on its own table or other support adjacent a gaming table (or other location where the wagering game is being played). The ball placement area may be elevated, such as above table height, to bring attention to the billiard balls 152 and/or to make it easier to see the balls. The ball placement area may be inset or lowered into the gaming table surface or other support surface in some embodiments. In one or more embodiments, the ball placement area may be adjacent the dealer position to allow a dealer to easily place billiard balls 152 into the ball placement area. In addition or alternatively, the ball placement area may be adjacent a mixing device to make it easier to remove billiard balls 152 from the mixing device and place them at the ball placement area (and vice versa).

The ball placement area may have various other configurations in addition to a ledger-type configuration. For example, the ball placement area may be a series or set of one or more boxes or compartments which accept individual billiard balls 152. The ball placement area could alternatively be a tube or channel configured to accept the billiard balls 152 one at a time as they are removed from a mixing device. The structure of a ball placement area, or portion thereof, may be transparent in some embodiments, to provide better visibility of the billiard balls 152.

It is contemplated that the ball placement area could comprise two rows of sections 208 where billiard balls 152 may be placed. Billiard balls that are in the correct position may be placed in a first row while billiard balls that are not in the correct position may be placed in the second row. In one embodiment, the first row may be in front of the second row relative to the players. This allows the player and dealer to easily recognize the billiard balls that are in the correct position(s).

FIG. 2B also illustrates an alternate ball placement area in the form of a landing 220 having one or more slots 224 to accept the billiard balls 152. The slots 224 may correspond to each section 208 of the landing 220. In addition, the slots 224 and adjacent areas of the landing 220 may be colored or have symbols to indicate desirable outcomes, such as described above.

In one or more embodiments, the billiard balls 152 may be manually removed from a mixing device and placed in order at a ball placement area, such as the ledgers 204 described above. It is contemplated that the billiard balls 152 may alternatively be automatically placed in order at a ball placement area by one or more delivery mechanisms. For example, a mixing device and ball placement area may be connected by one or more channels or guides that direct billiard balls 152 from the mixing device to the ball placement area while preserving their randomized order.

Referring to FIG. 2B, if the landing 220 is used as a ball placement area, it can be seen that billiard balls 152 from a mixing device 156 may be guided by one or more tracks 216 from the mixing device to the landing 220 (i.e. ball placement area). The billiard balls 152 would then automatically enter the slots 224 of the landing 220 in the order they emerge from the mixing device 156. In this manner, once a stopper or other blocking structure of the mixing device 156 is released, the billiard balls 152 automatically roll into individual slots 224 or sections of the landing 220. The movement of the billiard balls 152 from a mixing device 156 to a ball placement area adds visual interest to the wagering game and may serve to entice players to play the wagering game.

Once one or more rounds of a wagering game have been played, the billiard balls 152 may be returned to the mixing device 156 to be randomized again. For example, as discussed above, the billiard balls 152 may be inserted through an access point of the mixing device. In one or more embodiments, a cover or the like of the access point may first need to be opened or moved to allow the billiard balls 152 to be inserted into the mixing chamber of the mixing device 156.

Figure 3:
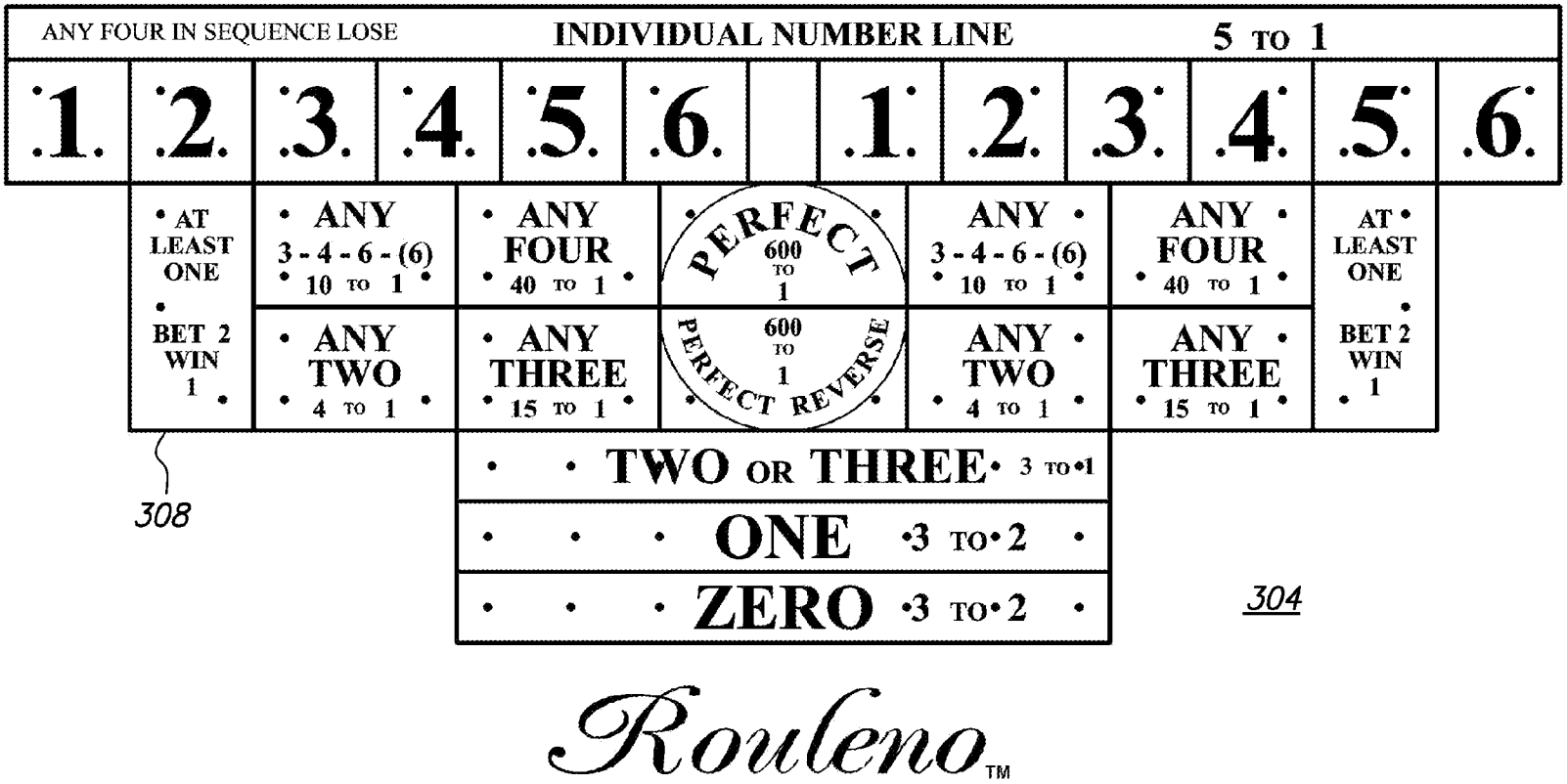
FIG. 3 illustrates an exemplary table layout for a billiard ball wagering game.

The wagering game utilizing the mixing device and billiard balls will now be described. FIG. 3 illustrates an exemplary table layout for the wagering game. As can be seen, the layout 304 may provide one or more betting areas 308 within which players may place their bets. Though shown as a particular shape and size it is noted that the layout 304 may have various shapes and sizes. Like wise the betting areas 308 (shown as circular, rectangular, or square) may have various shapes and sizes, as well as various orders or arrangements. The layout 304 may be printed on the felt (or other surface) of a gaming table. Alternatively, the layout 304 may be presented electronically, such as via a screen or display. In such embodiments, players may place wagers through an input device, such as a button or touch screen. It is contemplated that a single layout 304 may be used per wagering game. Alternatively, multiple layouts 304 may be used. For example, each player may have his or her own layout 304 at which to place wagers.

Each betting area 308 may comprise a label, text, graphics, or other indicator(s) offering a bet. For example, a betting area 308 may describe the bet to be made, its odds, its payout, or various combinations thereof. In this manner, a player may decide whether or not to place a bet in the betting area 308 upon viewing the betting area 308. In other words, a player may accept a betting area's offer by placing a wager within the betting area 308.

It is noted that a betting area 308 need not provide information describing a bet within its borders. For example, players may already know what bet is associated with a betting area 308 from prior knowledge or from playing the game before. In addition, it is contemplated that bet descriptions may be provided on a signed, on printed or electronic materials distributed to players or placed adjacent the wagering game for easy access. The betting areas 308 may have unique shapes, colors, labels, or other attributes which allow a betting area to be associated with a particular bet description. For example, betting areas and their associated bets may be color coded or indexed (by shape, text, or graphics for example).

As alluded to above, during play, a player may place a wager in a betting area 308 to indicate that the player accepts the bet represented by or associated with the betting area. In some embodiments, multiple players may place wagers in a single betting area 308. In such embodiments, each player's bet may be associated with the player that made it. For example, a player may place a colored marker, dot, or other indicator on or adjacent his or her bet to indicate that it is his or her bet. In another exemplary embodiment, each betting area 308 may have a plurality of colored dots or other marks. A player may place his or her bet on his or her colored dot or marker.

If the bet turns out to be a winning bet the player may be paid. If not, the player's wager may be collected. Wagers may be various amounts. In some embodiments, there may be a minimum and/or maximum wager limit that may be set by a gaming establishment, agreed to between the players, or the like. Multiple players may place wagers in a single betting area 308 in some embodiments. In other embodiments, a betting area 308 may be limited to one or another predefined number of wagers.

It is contemplated that automatic wager tabulation may be used in some embodiments. For example, a system may be used to automatically detect wagers within particular betting areas 308 and/or to determine the amount of such wagers. The system may also track which wager's belong to which players in some embodiments.

For example, the wagering game may be played at a gaming table that comprises one or more sensors which are capable of detecting wagers and/or wager amounts. To illustrate, the sensors may read wager amounts from gaming tokens, currency, or the like optically or via RFID or the like. Alternatively sensors may detect wagers and determine wager amounts by the weight of gaming tokens, currency, or the like. The sensors may be beneath one or more betting areas 308 in some embodiments such as to detect nearby tokens and/or currency. It is noted that wagers and wager amounts may also be detected and determined manually.

As discussed above, a betting area 308 may have odds and/or payout amounts associated therewith. As shown in FIG. 3 for example, the betting areas 308 have payout amounts printed within their borders. FIG. 4 illustrates an exemplary paytable that may be used with the wagering game. It is noted that the paytable may be used with or instead of the information at a betting area 308. For example, rather than presenting the payout amounts at the betting areas 308, such information could be presented at the paytable.

The paytable may provide a name for the wager or another indicator. In one or more embodiments, this indicator may be used to associate a row, column, or other section of the paytable with a betting area. For example, a row and a betting area having the same name may indicate that the payout amount at the paytable (e.g., 600 to 1 for "Perfect") is associated with the betting area having the same name or other matching indicator/characteristic.

The paytable of FIG. 4 also provides examples of winning outcomes for each wager. This is not required in all embodiments. In the second column of the paytable of FIG. 4, it can be seen that exemplary winning outcomes have been provided. The examples, show the billiard balls and their numbers above numbered sections. In general, a winning outcome is achieved if a player correctly bets the number of billiard balls that will be in the correct sections after the billiard balls have been randomized. A billiard ball is in the correct section if its number matches the section number. Alternatively or in addition, the billiard ball may be in the correct position if its color (or other characteristic) matches the color (or other characteristic) of a section. Though shown with six sections, it is contemplated that fewer or additional sections may be used.

Billiard balls are advantageous in the wagering game because they generally have both a number and a color that is unique to a particular ball. Therefore, winning outcomes may be easily determined by matching color and/or numbers to section colors and/or numbers in one or more embodiments. Players familiar with billiards may already know the number/color associations in billiard balls and thus would be able to identify billiard balls in correct positions even without viewing the number on the ball or on a ledger section.

Some exemplary winning outcomes will now be described referring to FIG. 4. A "Perfect" outcome may be a winning outcome where the randomized billiard balls emerge from a mixing device in increasing order from 1 to 6 (i.e., all the billiard balls are in the correct position). A "Perfect Reverse" outcome may be a winning outcome where the randomized billiard balls emerge in reverse order, from 6 to 1.

A player may also wager on the number of billiard balls that will emerge in the correct position after randomization. For example, a player may wager that none or zero of the billiard balls will be in the correct position (i.e., a "Zero" wager). As shown by the example winning outcome in the "Zero" row of the paytable, none of the billiard balls 3, 4, 1, 6, 2, 5 are in the correct position for this winning outcome. The player may also wager that a "One" outcome will occur. This is where only one of the billiard balls emerges in the correct position. For example, as shown in FIG. 4, billiard balls in the order 5, 2, 4, 1, 6, 3, would form a "One" winning outcome because billiard ball 2 is in the second position (i.e., is in its correct position). As can also be seen, a player may place "Any Two", "Any Three", "Any Four", "Two or Three", or "Any Three, Four, or Perfect" wagers. Typically, the randomized billiard balls would have to be in an order such that the number of balls specified in the wager are in the correct position(s). For example, an "Any Three" wager may require that three billiard balls be in the correct position in order to be a winning outcome. Likewise, an "Any Three, Four, or Perfect" wager may require that three, four, or all the billiard balls are in the correct position for the wager to be a winner. A player may also place an "At Least One" wager which requires at least one billiard ball to be in the correct position.

The paytable may also provide a payout amount as well in one or more embodiments. As can be seen, the exemplary paytable of FIG. 4 indicate how much a winning wager will be paid. To illustrate, a winning "Perfect" wager would pay 600 to 1 (i.e., 600 times the wagered amount). As can be seen, various winning outcomes may have various payout amounts. In general, the amount of payout will vary based on the likelihood of the outcome occurring. Typically, the greater the likelihood of an outcome, the lower the payout will be. As can be seen, a winning wager on "Any Two" pays less than a winning "Any Three" wager.

The payout amounts may be adjusted by a gaming establishment if desired. It is contemplated that the amounts may also be adjusted during a game. For example, a triggering outcome or event may alter the payout amounts for a period of time. To illustrate, in one embodiment, a triggering outcome or event may cause the game to enter a "bonus" period or mode where payouts are increased. In another embodiment, the appearance of a "special" billiard ball may trigger a bonus or trigger a change in the payout amounts. The special ball may have unique characteristic(s) compared to the other billiard balls. For example, the special ball may be metallic, light up, be larger or smaller, have a pattern (e.g., a checkerboard or stripped pattern), and the like. The special ball may also have a color, a number or both so as to allow the special ball to be evaluated to determine if a winning outcome has or has not occurred. It is contemplated that the payout amounts could be lowered as well. For example, if an unlucky ball appears (e.g., a black eight ball), payout amounts could be lowered for a period of time.

It is contemplated that the mixing device may have one or more elements which allow a special ball, unlucky ball, or other unique ball to be released into the mix. For example, if during mixing a billiard ball enters a particular area, structure, or portion of the mixing chamber, the ball may be retained therein while a unique ball is released into the mix. For example, a regular billiard ball may knock a unique ball into the mix and be retained in the unique ball's holding area. The particular area or structure of the mixing chamber may be configured such that it is unlikely that a billiard ball would enter the area. For example, the area may have a narrow opening. In this manner, the number of times a unique ball appears may be rare. It is contemplated that the opening (or other structure) may be configured to control how often a unique ball appears.

Alternatively, in some embodiments, an electronic or mechanical controller may randomly release a unique ball into the mix. It is contemplated that if a unique ball is included, a non-unique ball may be retained or kept in the mixing device. In such cases, the unique ball may have characteristics (e.g., a number or color) that allows it to be used to potentially form a winning outcome. Alternatively, the unique ball may be released in addition to the regular billiard balls. In such cases, the unique ball may be removed from the regular billiard balls, allowing the regular balls to potentially form a winning outcome. It one embodiment, the mixing device may be configured to "drop" or include unique balls after the regular billiard balls thus preventing the unique ball from interfering with the order of the billiard balls. For example, upon detecting that a particular number of balls have been removed or emerged from the mixing device, the mixing device may release a unique ball.

In some embodiments, the billiard balls may include indicia in addition to or instead of numbers. For example, the billiard balls may have playing card symbols, such as diamond, spades, clubs, and hearts, thereon with or without numbers and/or colors. Additional winning outcomes and/or bonuses may be provided based on these characteristics of the billiard balls. For example, an "Any Two" wager may pay a bonus amount if a ball with a particular playing card symbol (or other indicia) is at a particular position. Alternatively or in addition, the player may make a wager or side wager that a particular indicia or multiple indicial will be in a particular position or in particular positions.

It is noted that the paytable of the wagering game may contain a variety of winning outcomes and may define outcomes that are not winning outcomes. For example, individual number wagers (e.g., "One" wagers) may be paid at true odds, except when any four balls are in the correct positions. To illustrate, randomized billiard balls in the order 1, 2, 3, 4, 6, 5 or 6, 2, 3, 4, 5, 1 or 2, 1, 3, 4, 5, 6 may be defined as losing outcomes on the paytable. It is contemplated that other sequences of balls may be defined as losing outcomes as well.

Figure 5:
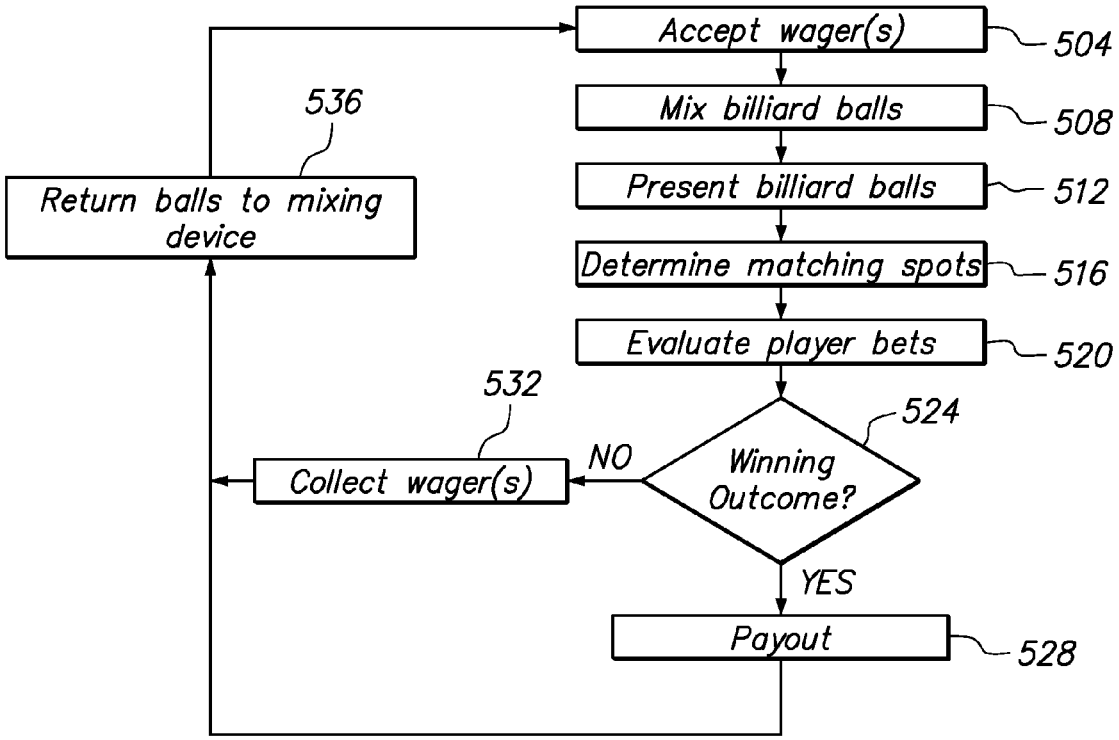
FIG. 5 is a flow diagram illustrating an exemplary billiard ball wagering game.

The wagering game will now be described with regard to FIG. 5, which provides a flow diagram illustrating the steps of an exemplary game. At a step 504, a wager may be accepted from one or more players. The wager may need to conform to the required minimum of the particular game. In general, a wager may be accepted by accepting the wager from a player at a betting area. For example, the player may place his or her wager within a betting area. By doing so, the player is wagering on the winning outcome associated with that betting area. It is contemplated that players may indicate which outcome they are wagering on in other ways. For example, the player may simply speak or name the outcome they are wagering on or select the outcome from a screen. Alternatively or in addition, the player may place a marker on or adjacent to the outcome they wish to bet on. A player may wager on one or more outcomes if desired, unless restricted to a particular number of wagers by the game rules.

Once the wagers have been accepted, the billiard balls may be randomized at a step 508. As discussed above, the randomization process may occur for a period of time and may include placing the billiard balls into a mixing device for randomization. Once randomized, the billiard balls may be presented to the players in their random order at a step 512. As discussed above, this may occur by removing the billiard balls from a mixing device and placing the billiard balls on a ledger or the like while preserving their random order. The billiard balls may be presented in other ways as well. For example, the billiard balls may roll or drop out of the mixing device in their random order once randomization is complete. Once the order of the billiard balls is visible, they may be evaluated to determine winning or losing wagers.

At a step 516, it may be determined which, if any, of the billiard balls are in the correct positions. For example, billiard balls having a number which matches the section of the ledger where they are positioned may be deemed in the correct position. As stated above, a correct position may occur when other characteristics of a billiard ball matches that of a section. For example, matching colors or symbols may be used to deem that a billiard ball is in the correct position. One benefit of using billiard balls is that the balls are colored as well as numbers. Thus, players and others may match the number, color, or both of a billiard ball to ledger sections to quickly and easily determine if the ball is in the correct position. This makes the game "approachable" to players encouraging play.

At a step 520, wagers from the one or more players may be evaluated to determine if the players are winners. This may occur in concert with the previous step. For example, if the random order of billiard balls has two balls in correct positions then player wagers may be evaluated to identify winning wagers. In this case, players that made "Any Two" wagers may be deemed winners. At a decision step 524, if a player has made a winning wager, the player may be may be given a payout at a step 528. If the player has not made a winning wager at decision step 524, such player's wager may be collected, such as by the gaming establishment at a step 532.

Once any winning players have been paid at step 528 and/or losing wagers collected at step 532, the billiard balls may be returned to a mixing device at a step 536 for randomization, such as for one or more subsequent games. If no additional games are to be played, the mixing device may be used to store the billiard balls. If at least one additional game is to be played, one or more additional wagers may be collected at step 504, and the subsequent game(s) may continue from that point as discussed above. It is noted that in wager games having an alterable paytable, alterations to such paytable may occur after the billiard balls are presented at step 512. For example, if a special ball, unlucky ball or other particular billiard ball or balls appears, the paytable may be altered for the particular game in progress or for one or more subsequent games.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A wagering game comprising:

a table layout comprising one or more betting areas, the one or more betting areas configured to accept at least one wager from one or more players;

a plurality of physical game balls, each of the plurality of balls comprising at least one unique indicia comprising a unique color;

a display area in which the plurality of balls may be presented to the one or more players in a random order, the display area having a plurality of locations arranged along a path, each of the plurality of locations configured to accept one of the plurality of balls and each of said locations displaying a different one of said unique colors; and a paytable comprising one or more winning outcomes, each of the one or more winning outcomes identifying at least a number of the plurality of balls that must be in a particular location of the display area.

2. The wagering game of claim 1, wherein the plurality of balls are billiard balls and the unique indicia of the billiard balls is a unique number and a unique color on each billiard ball.

3. The wagering game of claim 1, further comprising a mixing device configured to accept said plurality of balls, said mixing device comprising an enclosed mixing chamber configured to accept the one or more balls, and at least one agitator configured to move the plurality of balls into the random order.

4. The wagering game of claim 1, wherein said plurality of balls comprise six balls, each of said six balls displaying one of six unique colors and wherein said plurality of locations comprise six locations, each of said six locations displaying one of said six unique colors.

5. The wagering game of claim 1, wherein the one or more winning outcomes comprise a first winning outcome requiring one of the plurality of balls to be in a particular location of said display area, and a second winning outcome requiring at least two of the plurality of balls to be in at least two particular locations of said display area.

6. The wagering game of claim 1, wherein the one or more winning outcomes comprise a winning outcome requiring each of the plurality of balls to be in a particular location of said display area.

7. The wagering game of claim 1 further comprising a wagering layout designating one or more wagering locations, wherein a plurality of players may place wagers upon said one or more locations, each player's wagers designated by a particular color.

8. The wagering game of claim 1 wherein said particular color is based upon a seat position of said player.

9. The wagering game of claim 1 wherein said one or more winning outcomes comprise identifying at least one of said plurality of balls at a location of said display area where the color of said ball matches said color of said location of said display area.

10. The wagering game of claim 1 wherein each of said plurality of locations has a first position in which a ball is positioned if said unique color of said ball matches said unique color of said position and a second position in which said ball is positioned if said unique color of said ball does not match said unique color of said position.

11. A method for presenting a wagering game with billiard balls comprising:

accepting at least one wager from a player;

presenting a plurality of physical billiard balls in a random order to one or more players, each of said plurality of billiard balls displaying a unique color and number indicia relative to the other billiard balls, said billiard balls presented in a plurality of locations of a display area, each of said locations displaying a different one of said unique colors;

evaluating the position of the plurality of billiard balls relative to said locations of said display area; and paying the player a payout for correctly predicting the position of the plurality of billiard balls relative to said locations of said display area.

12. The method of claim 11, further comprising placing said plurality of billiard balls in a mixing chamber and rolling the plurality of billiard balls on a bottom of the mixing chamber.

13. The method of claim 11, further comprising placing said plurality of billiard balls in mixing chamber and rotating an agitator within the mixing chamber to roll the plurality of billiard balls.

14. The method of claim 11, wherein presenting the plurality of billiard balls comprises placing the plurality of billiard balls on a gaming table surface in the random order.

15. The method of claim 11 wherein said plurality of billiard balls comprise six billiard balls each bearing a unique number and one of six unique colors.

16. The method of claim 11 wherein said plurality of balls comprise six balls, each of said six balls displaying one of six unique colors and wherein said plurality of locations comprise six locations, each of said six locations displaying one of said six unique colors.

17. The method of claim 11 further comprising displaying a wagering layout designating one or more wagering locations and wherein each player's wager is designated by a particular color.

18. The method of claim 17 wherein said particular color is based upon a seat position of said player.

19. The method of claim 11 further comprising locating each ball in a first position or a second position of its corresponding location, wherein a ball is located in said first position of a location if said unique color of said ball matches said unique color of said position and wherein a ball is located in said second position of a location if said unique color of said ball does not match said unique color of said position.

* * * * *